United States Patent [19]

Czech et al.

[11] Patent Number: 4,793,820

[45] Date of Patent: Dec. 27, 1988

[54] ELECTRICAL WIRING HARNESS TERMINATION SYSTEM

[75] Inventors: James I. Czech, Lincoln Township, Berrien County; Shannon L. Madison, St. Joseph, both of Mich.

[73] Assignee: Whirlpool Corporation, Benton Harbor, Mich.

[21] Appl. No.: 135,649

[22] Filed: Dec. 21, 1987

[51] Int. Cl.[4] ..... H01R 29/00

[52] U.S. Cl. ..... 439/177; 439/741

[58] Field of Search ..... 439/177, 223, 224, 269, 439/516, 628, 682, 720, 741, 748, 749, 877

[56] References Cited

U.S. PATENT DOCUMENTS

| | | | |
|---|---|---|---|
| 2,158,004 | 5/1939 | Douglas | 173/323 |
| 2,336,517 | 12/1943 | Wade | 173/323 |
| 3,193,792 | 7/1965 | Shea, Jr. | 339/176 |
| 3,289,151 | 11/1966 | Mas et al. | 439/177 |
| 3,429,199 | 2/1969 | Kenyon | 74/548 |
| 3,493,919 | 2/1970 | Koltkamp | 439/741 |
| 3,775,828 | 12/1973 | Kopenhaver | 29/401 |
| 3,846,030 | 11/1974 | Katt | 403/2 |
| 4,260,216 | 4/1981 | Ackerman | 339/258 S |
| 4,353,611 | 10/1982 | Siebens et al. | 339/92 R |
| 4,370,009 | 1/1983 | Dola | 439/177 |
| 4,638,681 | 1/1987 | Eldridge, Jr. | 74/544 |

*Primary Examiner*—Gil Weidenfeld
*Assistant Examiner*—Paula A. Austin
*Attorney, Agent, or Firm*—Hill, Van Santen, Steadman & Simpson

[57] ABSTRACT

An electrical wiring harness termination system is provided which can be used with a replaceable electrical component wherein the component has a terminal that can be severed into a proximal portion connected to the component and a free distal portion. A wire lead is to be attached to the distal portion and the distal portion can be electrically connected to a terminal of a replacement component by use of a double-female connector. Since most components are never replaced, the present system is less costly than double terminal systems.

17 Claims, 1 Drawing Sheet

ELECTRICAL WIRING HARNESS TERMINATION SYSTEM

BACKGROUND OF THE INVENTION

1. Field of the Invention

The present invention relates to electrical connectors and more particularly to a termination system for electrical components.

2. Description of the Prior Art

Electrical components, such as those used in domestic appliances, include terminals wherein wires from a wiring harness are connected to the components, these wires electrically connecting the component to other components. The costs associated with a wiring harness consist primarily of insulated wire, terminals and the labor to attach the terminals to the insulated wire. Because of the high reliability of electrical components in such appliances, the great majority (75–90%) of the appliance's harness terminals will never need to be removed from the component terminals to which they are attached. If removal of leads from the component terminals is not necessary, the harness terminals are functionally redundant. This redundancy is costly and can adversely affect reliability since an additional electrical contact/interface exists with a terminal attached to the harness lead.

SUMMARY OF THE INVENTION

The present invention provides an electrical wiring harness termination system in which terminals at the wiring harness can be eliminated while providing a means of easy removal of the wiring harness from a component and easy reattachment of the wiring harness to a replacement component in the event the original component fails.

The invention provides terminals for a component which are longer than normal for a conventional one quarter inch wide terminal. The added cost of the longer terminal is less than that of a separate wiring harness terminal. The harness lead is directly terminated to the elongated component terminal. A termination can be achieved by conventional means such as laser welding, electrical staking, soldering, crimping, etc. The component terminal should be fabricated such that in the event of component failure, the component terminal can be easily separated into two sections, such separation accomplished by cutting with a hand tool or by flexing/work hardening a creased joint between the two sections, eventually fracturing the crease. Once the failed component is replaced, termination of the harness to the new component could be achieved by using a typical "piggy-back" double-female connector, or a variation of such a connector. The replacement component could be provided with the less costly currently conventional shorter terminals.

DESCRIPTION OF THE PREFERRED EMBODIMENTS

Figure 1:
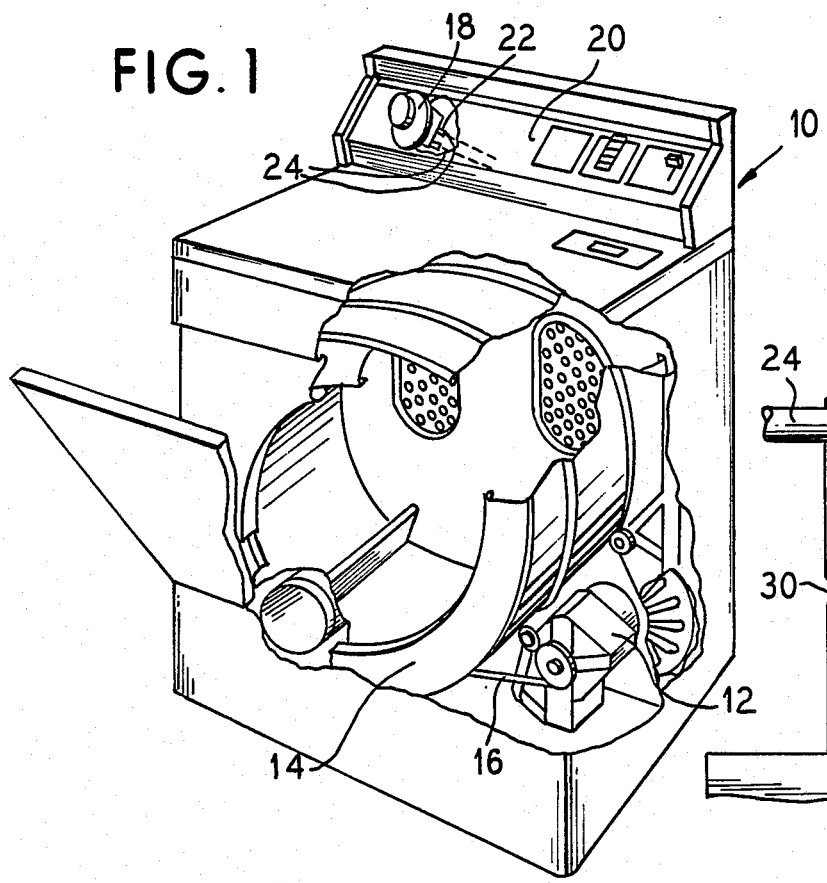
FIG. 1 is a perspective view of a dryer illustrating the use of the present invention in a domestic appliance.

In FIG. 1 there is illustrated a domestic appliance such as a dryer 10 in which the present invention could be utilized. The dryer 10 includes an electrical motor 12 which drives a rotating drum 14 by means of a drive belt 16. The dryer also includes a number of electrical components 18 such as a timer, mounted on a console 20. The electrical component 18 includes a plurality of terminals 22 which are connected to other components via electrical wires 24 which may form part of an electrical wiring harness.

Figure 2:
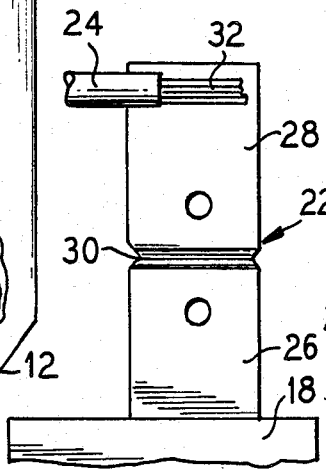
FIG. 2 is a front elevational view of a component terminal and attached wire harness lead.
Figure 3:
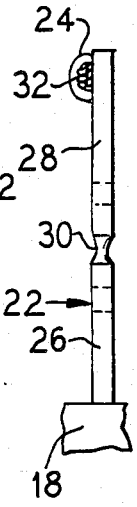
FIG. 3 is a side elevational view of the terminal of FIG. 2.

The terminal area of the electrical component 18 is shown in greater detail in FIGS. 2–6. In FIGS. 2 and 3 it is seen that the electrical component 18 has a terminal 22 which has a plate-like elongated rectangular shape and is divided into a proximal section 26 and distal section 28, the division occurring at a web or separation region including a crease or groove 30 extending laterally across the width of the terminal 22. The proximal section 26 of the terminal 22 is attached directly to the component 18 while the distal section 28 has a bared portion 32 of the electrical wire 24 attached to it by appropriate fastening means such as laser welding, electrical staking, soldering, crimping, etc. so that the wire is permanently attached to the distal section of the terminal.

Figure 4:
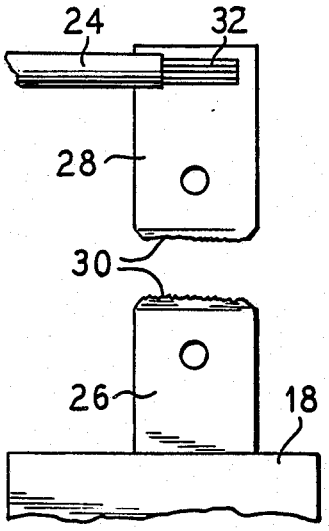
FIG. 4 is a front elevational view showing the component terminal separated into two sections.
Figure 5:
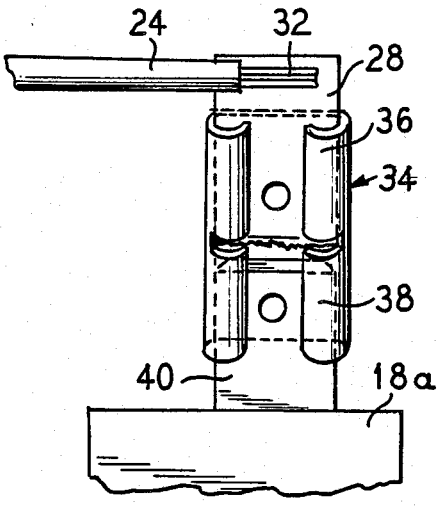
FIG. 5 is a front elevational view of the wire harness terminal section attached to a new component terminal by a connector.
Figure 6:
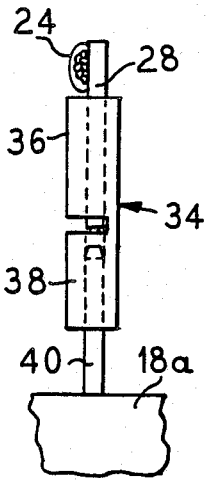
FIG. 6 is a side elevational view of the connector arrangement of FIG. 5.

In the vast majority of cases because of high component reliability, there is no need to remove the wire 24 from its connection to the component 18 and thus the terminal 22 will remain intact. However, occasionally components fail and must be replaced. When that occurs, the terminal 22 can be severed into two pieces along the crease 30 either by a cutting tool or by flexing/work hardening the creased joint, eventually fracturing the crease as is illustrated in FIG. 4. To reconnect the wire 24 and its still connected distal terminal section 28 to a replacement electrical component 18A, a "piggy-back" double-female connector 34 is provided as is illustrated in FIGS. 5 and 6 which has a first portion 36 for receiving the distal section 28 and a second portion 38 for receiving a terminal 40 of the replacement electrical component 18A.

The terminal 40 on the replacement component 18A can be shorter than the terminal 22 on the original component 18 and, preferably, would be of a shape and dimension substantially the same as the proximal portion 26 of the original component terminal 22. In this manner, the assembled height of the terminal connection after replacement of the component will be approximately the same as in the original arrangement.

As is apparent from the foregoing specification, the invention is susceptible of being embodied with various alterations and modifications which may differ particularly from those that have been described in the preceeding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. An electrical wiring harness termination system for use with a replaceable original electrical component comprising:

an electrical terminal extending from said original component having a proximal section secured to said component and a distal section extending away from said component, said terminal having a length sufficient to permit a severing of said terminal into separate proximal and distal sections;

a wire lead connected to said terminal at said distal section;

a replacement component having a terminal; and a connector means for securing a severed distal section to said terminal of said replacement component.

2. An electrical wiring harness termination system according to claim 1, wherein said replacement component terminal has a length approximately the same as the proximal section of the original component terminal.

3. An electrical wiring harness termination system according to claim 1, wherein said original component terminal includes a separation region between said proximal and distal sections to provide a defined space for said severing.

4. An electrical wiring harness termination system according to claim 3, wherein said separation region includes a crease extending laterally across said terminal to assist in said severing.

5. An electrical wiring harness termination system according to claim 1, wherein said connector means comprises a connector member having means for receiving said severed distal section and said replacement component terminal.

6. An electrical wiring harness termination system according to claim 5, wherein said original component terminal and said replacement component terminal comprise plate-like members having a rectangular shape and said connector member comprises a double-female connector for receiving both plate-like members in a sliding connection.

7. An electrical wiring harness termination system for use with a replaceable original electrical component and a replacement component wherein said components have terminals which are connected by wires from said wiring harness to other components comprising:

electrical terminals on said original component having a length sufficient to permit a severing of said terminals into separate proximal and distal portions, said wire connection at said terminals occurring at said distal portions, and a connector means for securing severed distal portions to said replacement component terminals.

8. An electrical wiring harness termination system according to claim 7, wherein said wire is permanently connected to said distal portion of said original component terminal.

9. An electrical wiring harness termination system according to claim 7, wherein said original component terminals have a separation region between said proximal and distal portions to provide a defined space for said severing.

10. An electrical wiring harness termination system according to claim 9, wherein said separation region includes a groove extending laterally across said terminal to assist in said severing.

11. A method of replacing an electrical component having a wire connection at a terminal comprising the steps:

severing said terminal into proximal and distal portions, said wire connection being at the distal portion, removing the component and replacing it with a replacement component, and attaching a connecting member to said severed distal portion and to a terminal of said replacement component to provide the wire connection to said replacement component.

12. A method according to claim 11, wherein said severing step is accomplished by cutting said terminal with a hand tool.

13. A method according to claim 11, wherein said severing step is accomplished by repeatedly bending said terminal between said proximal and distal portions.

14. A method according to claim 11, wherein said attaching step is accomplished by sliding said severed distal portion into a first receiving portion and by sliding said replacement component terminal into a second receiving portion of the connector.

15. An electrical wiring harness termination system for use with a replaceable original electrical component comprising an electrical terminal extending from said original electrical component, said electrical terminal comprising:

a proximal section secured to said component;

a distal section extending away from said proximal section; and a weakened web portion interconnecting said proximal and distal section such as to facilitate severing of said proximal and distal sections.

16. An electrical wiring harness termination system according to claim 15 further comprising connector means for securing said severed distal section to a terminal of a replacement electrical component.

17. An electrical wiring harness termination system according to claim 15, wherein said proximal and distal sections are flat and said web comprises a groove extending laterally across said terminal.

* * * * *